US009970252B2

(12) United States Patent
Nguyen

(10) Patent No.: US 9,970,252 B2
(45) Date of Patent: May 15, 2018

(54) DUAL LOCK SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 503 days.

(21) Appl. No.: 14/514,150

(22) Filed: Oct. 14, 2014

(65) Prior Publication Data

US 2016/0102512 A1 Apr. 14, 2016

(51) Int. Cl.
*E21B 23/02* (2006.01)
*E21B 33/04* (2006.01)
*E21B 43/10* (2006.01)

(52) U.S. Cl.
CPC ..... *E21B 23/02* (2013.01); *E21B 33/04* (2013.01); *E21B 43/10* (2013.01)

(58) Field of Classification Search
CPC ..... E21B 23/02; E21B 43/10; E21B 33/04
See application file for complete search history.

(56) References Cited

U.S. PATENT DOCUMENTS

| | | | | |
|---|---|---|---|---|
| 2,358,677 A | | 9/1944 | Yancey | |
| 3,250,331 A | | 5/1966 | Boyle | |
| 3,351,133 A | | 11/1967 | Clark, Jr. et al. | |
| 3,376,935 A | | 4/1968 | Baker | |
| 3,385,370 A | | 5/1968 | Knox et al. | |
| 3,913,670 A | | 10/1975 | Ahlstone | |
| 3,924,679 A | | 12/1975 | Jansen, Jr. | |
| 3,933,202 A | | 1/1976 | Ahlstone | |
| 4,003,434 A | * | 1/1977 | Garrett | E21B 33/043 166/120 |
| 4,058,162 A | | 11/1977 | Smith | |
| 4,121,660 A | | 10/1978 | Koleilat | |
| 4,381,868 A | | 5/1983 | Croy et al. | |
| 4,657,083 A | | 4/1987 | Ringgenberg | |
| 4,667,986 A | | 5/1987 | Johnson et al. | |
| 4,736,799 A | * | 4/1988 | Ahlstone | E21B 33/047 166/182 |
| 4,791,992 A | * | 12/1988 | Greenlee | E21B 33/128 166/187 |
| 4,825,945 A | | 5/1989 | Smith | |
| 4,848,469 A | | 7/1989 | Baugh et al. | |
| 5,174,376 A | * | 12/1992 | Singeetham | E21B 33/043 166/182 |

(Continued)

FOREIGN PATENT DOCUMENTS

| | | |
|---|---|---|
| EP | 0370744 A1 | 5/1990 |
| GB | 2291449 A | 1/1996 |

(Continued)

OTHER PUBLICATIONS

PCT International Search Report & Written Opinion; Application No. PCT/US2015/051537; dated Dec. 1, 2015; 11 pages.

*Primary Examiner* — Robert E Fuller
*Assistant Examiner* — David Carroll
(74) *Attorney, Agent, or Firm* — Fletcher Yoder, P.C.

(57) ABSTRACT

A system including a mineral extraction system, including a hanger, and a dual lock system configured to couple the mineral extraction system component to a tubular, wherein the dual lock system comprises an outer lock ring and an inner lock ring.

22 Claims, 6 Drawing Sheets

(56) References Cited

U.S. PATENT DOCUMENTS

| | | | |
|---|---|---|---|
| 5,320,181 | A | 6/1994 | Lantier, Sr. et al. |
| 5,511,617 | A | 4/1996 | Snider et al. |
| 5,782,297 | A | 7/1998 | Samuels et al. |
| 5,909,769 | A | 6/1999 | Duhon et al. |
| 5,996,695 | A | 12/1999 | Koleilat et al. |
| 6,260,850 | B1 | 7/2001 | Beall et al. |
| 6,283,477 | B1 | 9/2001 | Beall et al. |
| 6,349,771 | B1 | 2/2002 | Luke |
| 6,497,291 | B1 | 12/2002 | Szarka |
| 6,585,048 | B1 | 7/2003 | Heijnen |
| 6,622,795 | B2 | 9/2003 | Hebert et al. |
| 6,834,726 | B2 | 12/2004 | Giroux et al. |
| 6,969,070 | B2 | 11/2005 | Reimert et al. |
| 6,988,556 | B2 | 1/2006 | Vick, Jr. |
| 7,069,987 | B2 | 7/2006 | Kwasniewski et al. |
| 7,111,688 | B2 | 9/2006 | Van Bilderbeek |
| 7,128,143 | B2 | 10/2006 | Van Bilderbeek |
| 7,137,453 | B2 | 11/2006 | Gustafson et al. |
| 7,308,934 | B2 | 12/2007 | Swagerty et al. |
| 7,527,104 | B2 | 5/2009 | Branch et al. |
| 2002/0023758 | A1 | 2/2002 | George et al. |
| 2006/0108119 | A1 | 5/2006 | Bailey et al. |
| 2007/0039738 | A1* | 2/2007 | Fenton ..... E21B 47/09 166/368 |
| 2007/0079990 | A1 | 4/2007 | Borak |
| 2009/0090515 | A1 | 4/2009 | Chan et al. |
| 2010/0051261 | A1 | 3/2010 | Koleilat et al. |

FOREIGN PATENT DOCUMENTS

| | | | |
|---|---|---|---|
| GB | 2408989 | A | 6/2005 |
| WO | 02/38913 | A1 | 5/2002 |
| WO | 2009/014795 | A2 | 1/2009 |

* cited by examiner

DUAL LOCK SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of a well. Such hangers may be disposed within a wellhead that supports both the hanger and the string. For example, after drilling, a tubing hanger may be lowered into a wellhead and supported on a ledge or landing within a casing to facilitate the flow of hydrocarbons out of the well. Unfortunately, casings with preformed ledges or landings reduce the size of the bore, which requires either smaller drilling equipment to fit through the bore or larger more expensive casings with larger bores.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a dual lock system and a setting tool. The dual lock system enables a wellhead to include casings without a preformed hanger landing. Accordingly, the casing may be smaller while still providing a bore size that accommodates standard drilling equipment. The dual lock system thereby enables complete use of the casing bore during drilling operations, while supporting the hanger (e.g., tubing hanger) once drilling operations stop. For example, after drilling operations, the setting tool may lower and couple a hanger to a casing with the dual lock system. As will be explained in detail below, the dual lock system includes an inner lock ring and an outer lock ring that couple to the respective hanger and casing. The setting tool energizes the inner and outer lock rings with inner and outer pistons via inner and outer energizing rings.

Figure 1:
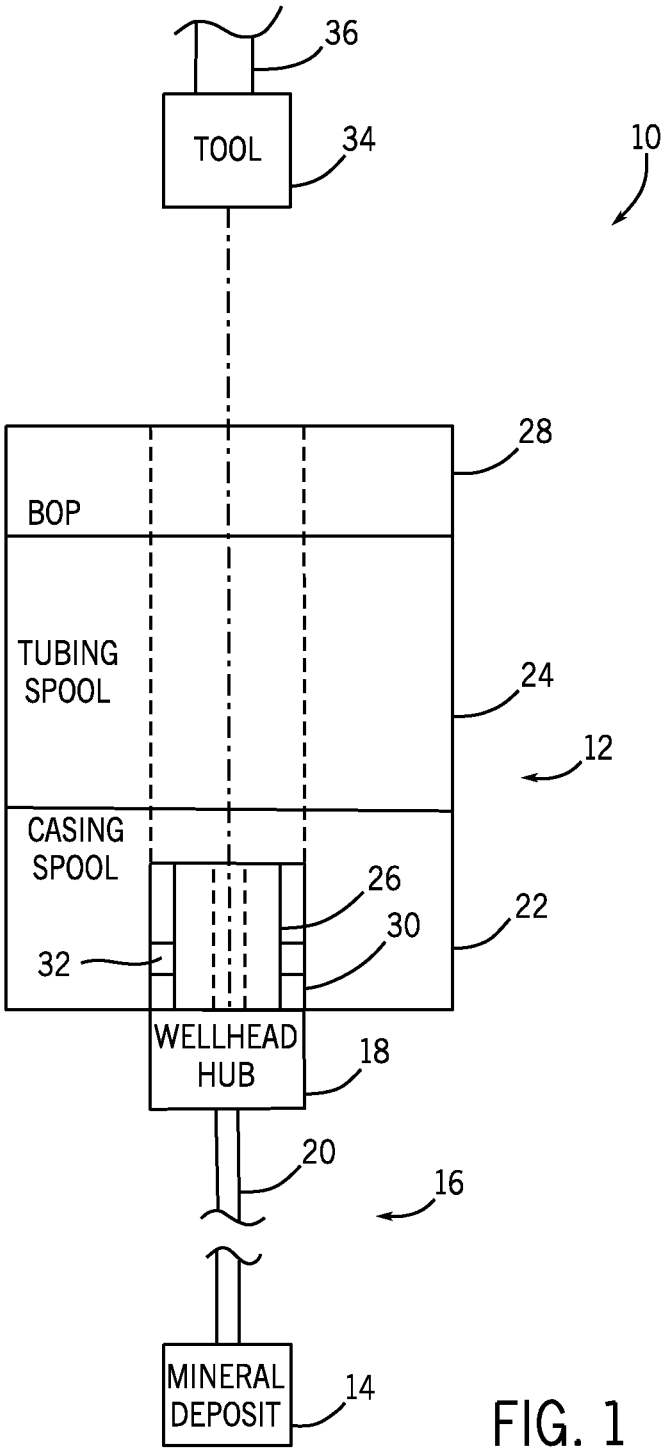
FIG. 1 is a block diagram of an embodiment of a mineral extraction system with a dual lock system.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. In some embodiments, the mineral extraction system 10 is land-based (e.g., a surface system) or subsea (e.g., a subsea system). The system 10 includes a wellhead 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 typically includes multiple components that control and regulate activities and conditions associated with the well 16. For example, the wellhead 12 includes a casing spool 22 (e.g., tubular), a tubing spool 24 (e.g., tubular), a hanger 26 (e.g., a tubing hanger or a casing hanger), and a blowout preventer (BOP) 28.

In operation, wellhead 12 enables completion and workover procedures, such as tool insertion (e.g., the hanger 26) into the well 16 and the injection of various chemicals into the well 16. Further, minerals extracted from the well 16 (e.g., oil and natural gas) may be regulated and routed via the wellhead 12. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 12 and the well 16. Thus, the casing spool bore 30 may provide access to the well bore 20 for various completion and workover procedures. For example, after drilling, the tubing hanger 26 may be inserted into the wellhead 12 and disposed in the casing spool bore 30. In the casing spool bore 30, the tubing hanger 26 may be secured to the casing spool 22 with a dual lock system 32. In order to activate the dual lock system 32, the mineral extraction system 10 may include a setting tool 34 that couples to a drill string 36. In operation, the drill string 36 simultaneously lowers the dual lock system 32 and tubing hanger 26 into wellhead 12. Once in place, the setting tool 34 energizes the dual lock system 32, which couples the tubing hanger 26 to the casing spool 22. As explained above, the ability to couple the dual lock system 32 to the wellhead 12 and tubing hanger 26, after drilling operations, maximizes use of the casing spool bore 30 to receive drilling equipment during drilling operations, while still enabling the tubing hanger 26 to couple to the casing spool 22 once drilling operations stop.

Figure 2:
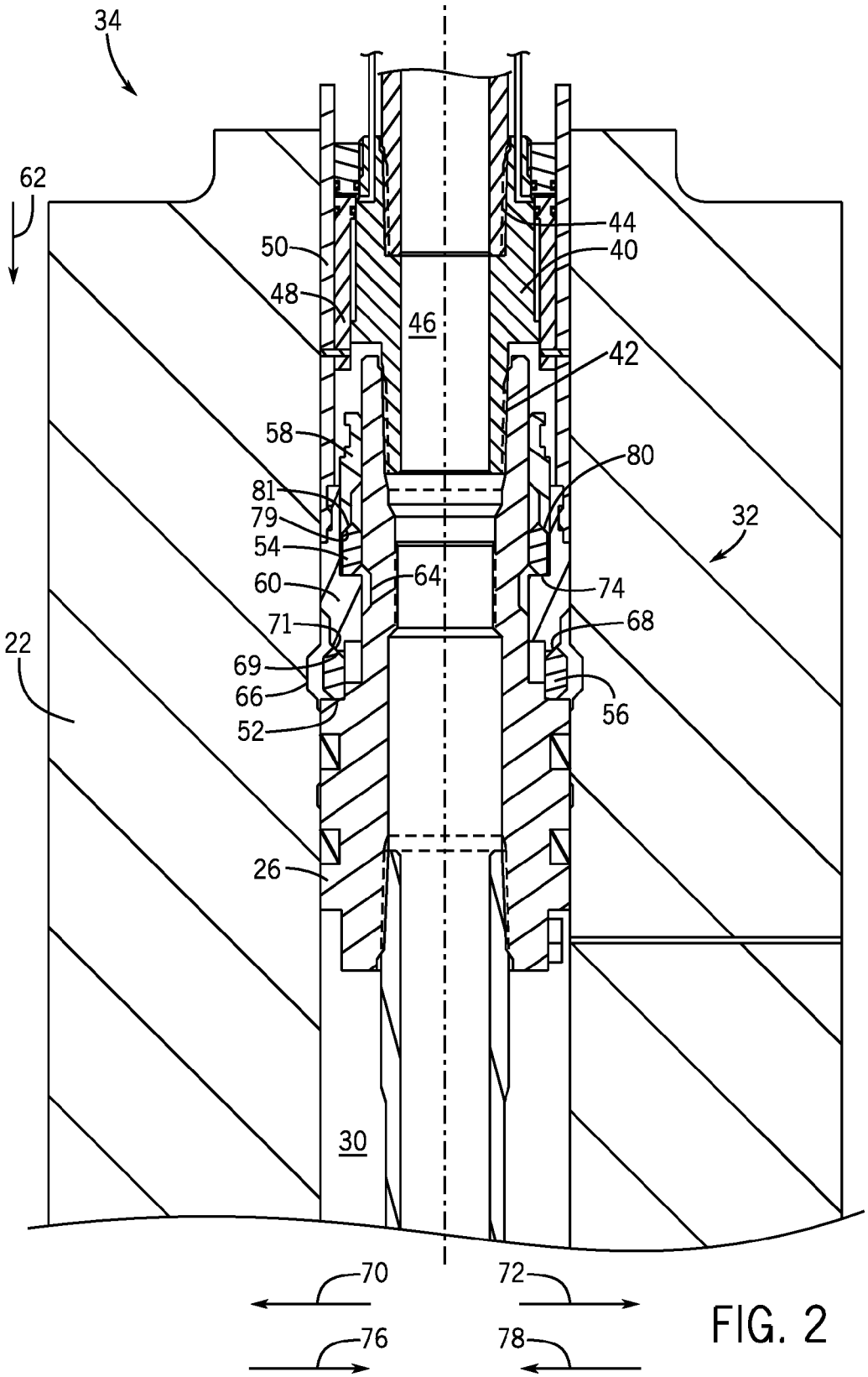
FIG. 2 is a cross-sectional side view of an embodiment of a dual lock system and a setting tool in an unenergized state.

FIG. 2 is a cross-sectional side view of an embodiment of the dual lock system 32 and setting tool 34 coupled to the tubing hanger 26. As explained above, the drill string 36 lowers the tubing hanger 26, dual lock system 32, and setting tool 34 into the wellhead 12. Once inside the wellhead 12, the setting tool 34 energizes the dual lock system 32 to couple the tubing hanger 26 to the wellhead 12. The setting tool 34 includes a block 40 (e.g., tubular body, hydraulic block) with a first end 42, a second end 44, and an axial bore 46 extending axially between the first and second ends 42, 44. As illustrated, the first end 42 of the setting tool 34 couples (e.g., threadingly couples) to the tubing hanger 26, and the second end 44 couples (e.g., threadingly couples) to the drill string 36. The setting tool 32 also includes inner and outer pistons 48, 50 (e.g., annular pistons) that couple to the second end 44 of the block 40. In operation, the setting tool 32 uses the inner and outer pistons 48, 50 to energize the dual lock system 32.

The dual lock system 32 circumferentially surrounds the tubing hanger 26 and may be supported by a tubing hanger ledge 52 (e.g., an annular recess and shoulder). The dual lock system 32 includes an inner lock ring 54 and an outer lock ring 56, as well as inner and outer energizing rings 58, 60. In some embodiments, the inner and outer lock rings 54 and 56 may be locking dogs or ring segments. In operation, the inner and outer energizing rings 58, 60 transfer force from the inner and outer pistons 48, 50 to the inner and outer lock rings 54, 56. More specifically, as the inner and outer pistons 48, 50 move in axial direction 62, the inner and outer pistons 48, 50 axially drive the inner and outer energizing rings 58, 60. The inner and outer energizing rings 58, 60 then drive the inner and outer lock rings 54, 56 into grooves 64 and 66 (e.g., circumferential or annular grooves) locking the tubing hanger 26 within the casing spool 22.

In some embodiments, the outer lock ring 56 contacts the outer energizing ring 60 at an angled interface 68 (e.g., tapered annular interface) formed by angled surfaces 69, 71 (e.g., tapered circumferential or annular surfaces). The angled interface 68 enables the outer energizing ring 60 to drive the outer lock ring 56 radially outward, in directions 70 and 72, and into the groove 66 as the outer energizing ring 60 slides circumferentially behind the outer lock ring 56. In some embodiments, the outer energizing ring 60 may include a ledge 74 (e.g., annular shoulder and recess) that supports the inner lock ring 54. Accordingly, as the outer energizing ring 60 moves in axial direction 62, the outer energizing ring 60 moves in axial direction 62 axially aligning the inner lock ring 54 with the groove 64 (e.g., circumferential groove) in the tubing hanger 26. The inner energizing ring 58 then energizes the inner lock ring 54 driving the inner lock ring 54 radially inward in directions 76 and 78, and into the groove 64. The inner energizing ring 58 and inner lock ring 54 likewise include an angled interface 80 (e.g., tapered circumferential or annular interface) with angled surfaces 79 and 81, like the angled interface 68 between the outer lock ring 56 and the outer energizing ring 60. In operation, the angled interface 80 enables the inner energizing ring 58 to slide past the inner lock ring 54, driving the inner lock ring 54 radially inward, in directions 76 and 78, and into the groove 64. The inner energizing ring 58 may then continue to move in axial direction 62 until the inner energizing ring 58 contacts the ledge 74. In this position, the inner energizing ring 58 circumferentially surrounds the inner lock ring 54 retaining the inner lock ring 54 in the groove 64 (e.g., blocks radial movement out of groove 64).

Figure 3:
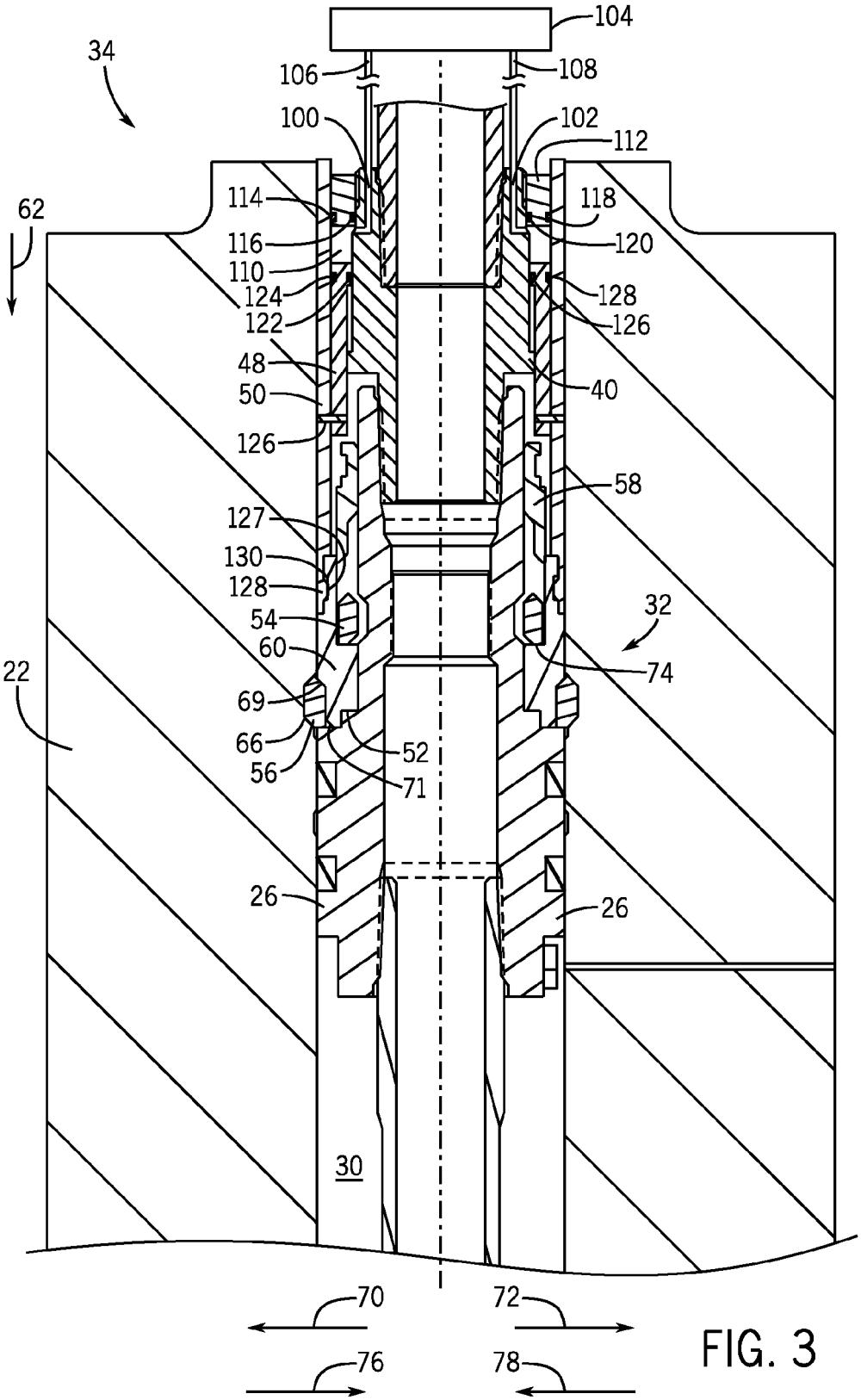
FIG. 3 is a cross-sectional side view of an embodiment of a setting tool energizing an outer lock ring of a dual lock system.

FIG. 3 is a cross-sectional side view of an embodiment of a setting tool 34 energizing the outer lock ring 56 of the dual lock system 32. As illustrated, the block 40 includes two or more hydraulic passages 100 and 102 that fluidly couple to a hydraulic source 104 with hydraulic lines 106 and 108. In some embodiments there may be only one hydraulic passage that communicates with only one hydraulic line. In operation, the hydraulic passages 100 and 102 enable hydraulic fluid to pass through the block 40 and into the cavity 110. In some embodiments, there may be one or more hydraulic lines that fluidly communicate with passages that fluidly communicate. The setting tool 34 forms the cavity 110 between the block 40 and the inner and outer pistons 48, 50. In order to seal the cavity 110, the setting tool 34 may include a retaining ring 112 with seals 114 and 116. For example, the retaining ring 112 may include seals 114 and 116 (e.g., annular seals) that rest within respective grooves 118 and 120 (e.g., annular grooves). The inner piston 48 may also include seals 122 and 124 (e.g., annular seals) that rest within grooves 126 and 128 (e.g., annular grooves) in the inner piston 48. This combination of seals 114 and 116 on the retaining ring 112 and the seals 122 and 124 on the inner piston 48 seals the cavity 110 enabling the pressurized fluid entering the cavity 110 to drive the inner and outer pistons 48 and 50 in axial direction 62 (e.g., without rotation). As illustrated, the setting tool 34 is able to drive both the inner and outer pistons 48, 50 using a single pressurized cavity 110. For example, the inner and outer pistons 48, 50 may couple together with a shear pin 126. Accordingly, as fluid enters the cavity 110, the fluid drives the inner piston 48 and the outer piston 50 together in axial direction 62.

As illustrated, the outer piston 50 couples to the outer energizing ring 60 with a radial protrusion 127 on a finger 128 (e.g., annular protrusion or circumferentially spaced axial protrusions) that rests within a groove 130 (e.g., annular groove) in the energizing ring 60. For example, the finger 128 may snap into the groove 130 or rotatingly engages the groove 130 after entering a slot in the outer energizing ring 60. In some embodiments, the energizing ring 60 may include the finger 128 and the outer piston 50 may include the groove 130. As explained above, the movement of the outer piston 50 in axial direction 62 drives the outer lock ring 56 into the groove 66 as the angled surface 71 of the outer energizing ring 60 slides past the angled surface 69 of the outer lock ring 56. After driving the outer lock ring 56 into the groove 66, the energizing ring 60 may continue to move in axial direction 62 until the outer energizing ring 60 contacts the ledge 52 (e.g., annular ledge). In this position, the energizing ring 60 blocks radial movement of the outer lock ring 56 out of the groove 66 in directions 76 and 78.

Figure 4:
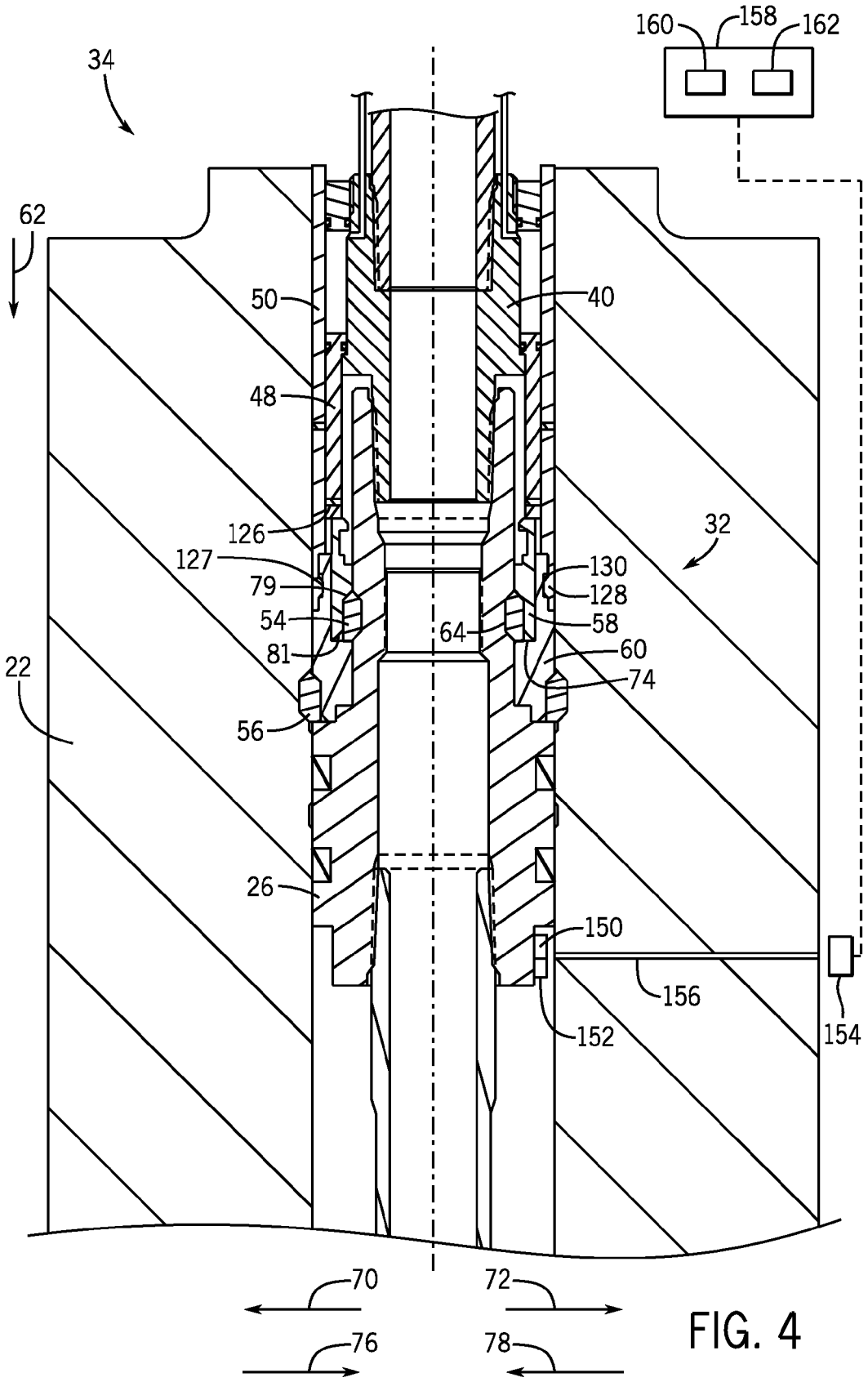
FIG. 4 is a cross-sectional side view of an embodiment of a setting tool energizing an inner lock ring of a dual lock system.

FIG. 4 is a cross-sectional side view of an embodiment of the setting tool 34 energizing the inner lock ring 54 of the dual lock system 32. After landing the energizing ring 60 on the ledge 52 and setting the outer lock ring 56 in the groove 66, the setting tool 34 continues to apply pressure on inner piston 48. Eventually, the fluid pressure in the cavity 110 overcomes the strength of the shear pin 126, causing the shear pin 126 to shear. Once the shear pin 126 shears, the inner piston 48 moves in axial direction 62 and into contact with the inner energizing ring 58. The inner piston 48 then drives the inner energizing ring 58 in axial direction 62. As the angled surface 81 of the inner energizing ring 58 slides past the angled surface 79 of the inner lock ring 54, the energizing ring 58 drives the inner lock ring 54 into the groove 64 in radial directions 76 and 78. The energizing ring 58 may then continue to move in axial direction 62 until the inner energizing ring 58 contacts the ledge 74 (e.g., annular ledge) of the outer energizing ring 60. In this position, the inner energizing ring 58 blocks movement of the inner lock ring 54 out of the groove 64 (e.g., in radial direction) and secures the tubing hanger 26 to the casing spool 22. Once the dual lock system 32 is set, the block 40 uncouples (e.g., unthreads, etc.) from the tubing hanger 26 and is withdrawn from the wellhead 12. As the setting tool 34 withdraws, the finger 128 of the outer piston 50 uncouples from the groove 130 (e.g., pops out, or rotates out of the groove 130 before being withdrawn from a slot in the outer energizing ring 60) disconnecting the setting tool 34 from the dual lock system 32.

In some embodiments, the setting tool 34 may include a light emitting device 150 (e.g., laser) coupled to a power source 152 (e.g., a battery). As the tubing hanger 26 is lowered into the wellhead 12, the light emitting device 150 (e.g., laser unit) emits light (e.g., laser beam) that passes through an aperture 156 in the casing spool 22. The light may be continuously or periodically emitted from the light emitting device 150, enabling a sensor 154 to detect the light once the hanger 26 reaches an aperture 156. Once the sensor 154 detects light from the light emitting device 150 through the aperture 156, the mineral extraction system 10 may stop movement of the setting tool 34 in axial direction 62, thus aligning the outer lock ring 56 with the recess 66. In some embodiments, a controller 158 may control movement of the setting tool 34 in response to light detection by the sensor 154. For example, the controller 158 may couple to the sensor 154 and to the mineral extraction system 10. As the sensor 154 detects light from the light emitting device 150, a processor 160 in the controller 158 may execute instructions stored by the memory 162 to stop movement of the setting drill string 36. In some embodiments, the device 150 may be a proximity sensor, contact sensor, non-contact sensor, optical sensor, capacitive sensor, clearance sensor, wireless device, magnetic sensor, etc. that facilitates alignment of the outer lock ring 56 with the recess 66. In another embodiment, the exact distance from the surface to the recess 66 may be known, enabling the setting tool 34 to be lowered to a proper position within the wellhead 12 without the controller 158 and the sensor 154. In still another embodiment, the casing spool 22 may have a small shoulder in the bore 30 that blocks movement of the hanger 26 to align the outer lock ring 56 with the recess 66.

Figure 5:
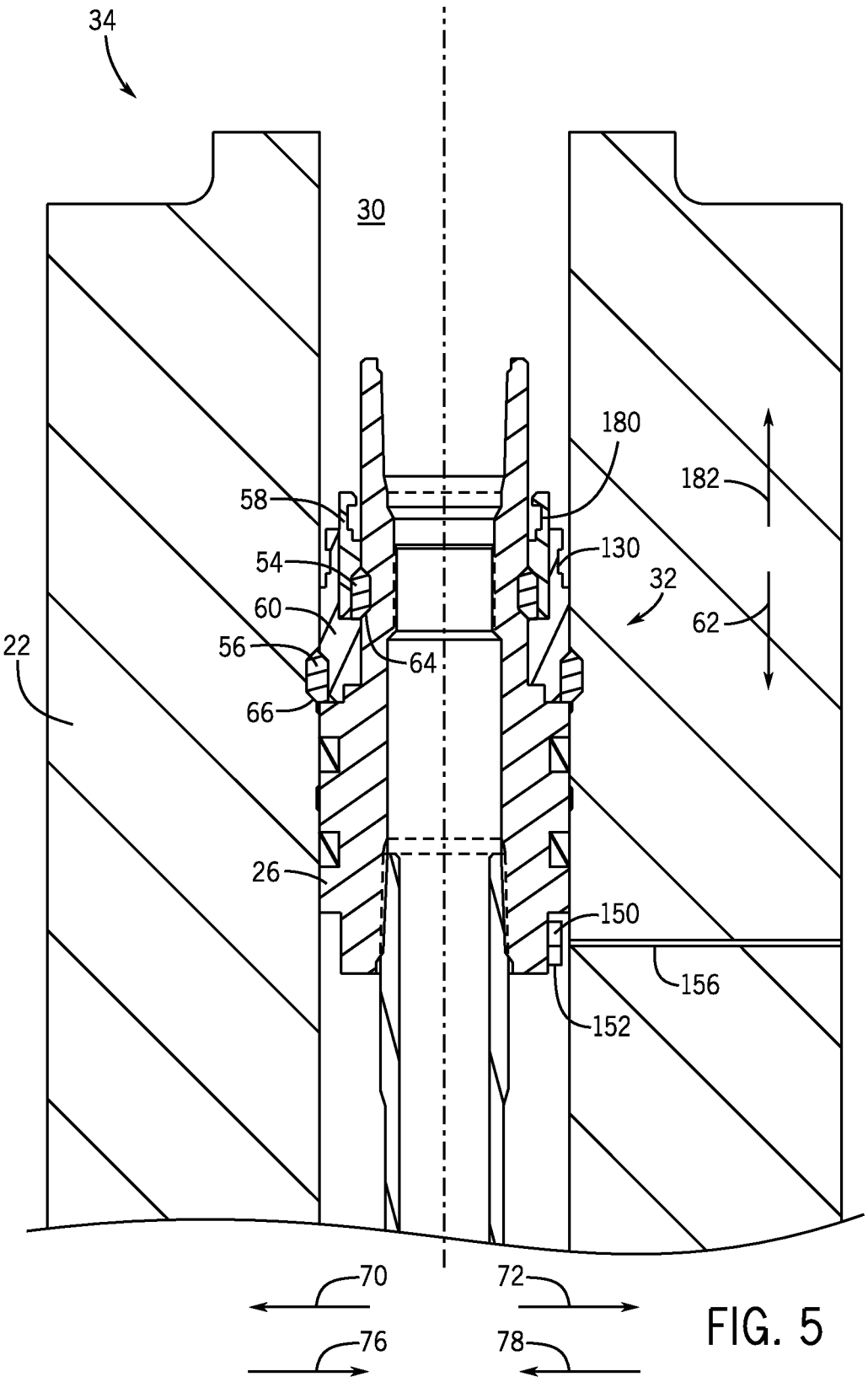
FIG. 5 is a cross-sectional side view of an embodiment of a tubing hanger locked within a wellhead with a dual lock system.

FIG. 5 is a cross-sectional side view of the tubing hanger 26 coupled to the casing spool 22 with the dual lock system 32. As illustrated, the dual lock system 32 is in an energized state with outer lock ring 56 coupled to casing spool 22 and the inner lock ring 54 coupled to the tubing hanger 26. In this position, the dual lock system 32 is able to lock the tubing hanger 26 within the wellhead 12. After use, the tubing hanger 26 may be removed from the wellhead 12 by unlocking the dual lock system 32. As illustrated, the inner energizing ring 58 includes a groove 180 (e.g., annular groove) and the outer energizing ring 60 includes the groove 130 (e.g., annular groove). During removal operations, a removal tool couples to the groove 180 in the inner energizing ring 58 (e.g., snaps into the groove 180, rotatingly engages the groove 180 after entering a slot in the inner energizing ring 58, etc.) and withdraws the inner energizing ring 58 in axial direction 182, enabling the inner lock ring 54 to retract from the groove 64. The removal tool then couples to the groove 130 on the outer energizing ring 60 (e.g., snaps into the groove 130, rotatingly engages the groove 130 after entering a slot in the outer energizing ring 60, etc.), pulling the outer energizing ring 60 in direction 182 to retract the outer lock ring 56 from the groove 66 in the casing spool 22. After both inner and outer lock rings 54, 56 disengage the tubing hanger 26 may be withdrawn out of the well 12.

Figure 6:
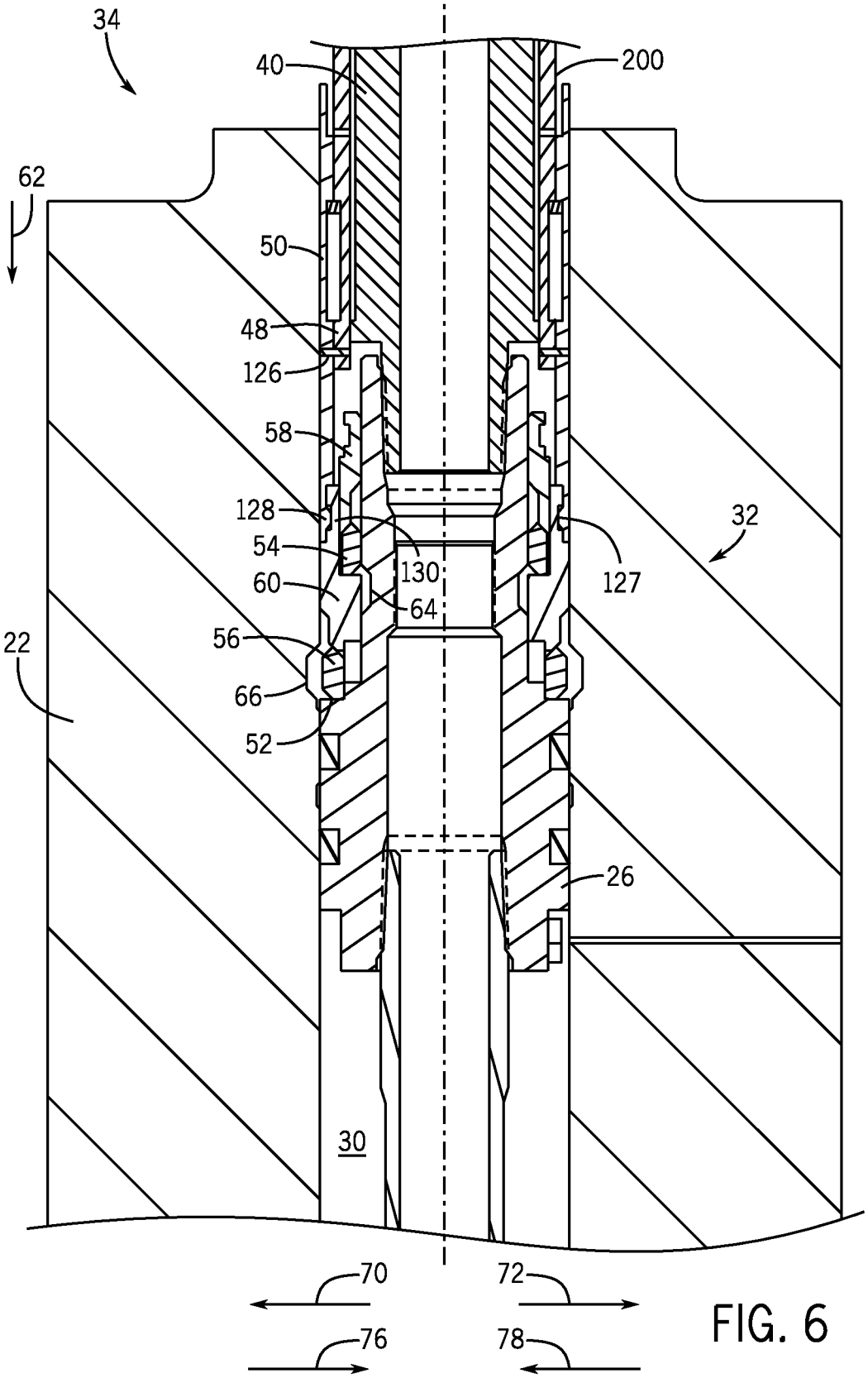
FIG. 6 is a cross-sectional side view of an embodiment of a dual lock system and a setting tool in an unenergized state.

FIG. 6 is a cross-sectional side view of an embodiment of a dual lock system 32 and a setting tool 34 in an unenergized state. In contrast to the setting tool 34 above that operates with hydraulics, the setting tool 34 in FIG. 6 may be a manually operated tool that energizing the dual lock system 32. For example, the setting tool 34 may include a threaded sleeve or tool piston 200 (e.g., annular threaded piston) that rotates about the block 40. In operation, rotation of the piston 200 moves the piston 200 axially in direction 62 and into contact with the inner piston 48. As explained above, the inner piston 48 couples to the outer piston 50 with the shear pin 126. Accordingly, as the inner piston 48 moves in axial direction 62, the outer piston 50 moves in axial direction 62 driving the outer energizing ring 60 which locks the outer lock ring 56 in the groove 66. After landing the energizing ring 60 on the ledge 52 and setting the outer lock ring 56 in the grove 66, the setting tool 34 continues to drive the inner piston 48 with the tool piston 200. Eventually, the force of the piston 200 overcomes the strength of the shear pin 126, causing the shear pin 126 to shear. The inner piston 48 is then able to contact the inner energizing ring 58, driving the inner energizing ring 58 to lock the inner lock ring 54 in the groove 64. Once the dual lock system 32 is set, the block 40 uncouples (e.g., unthreaded, etc.) from the tubing hanger 26 and is withdrawn from the wellhead 12. As setting tool 34 withdraws, the finger 128 of the outer piston 50 uncouples from the groove 130 (e.g., pops out) disconnecting the setting tool 34 from the dual lock system 32.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a mineral extraction system, comprising:

a hanger; and a dual lock system configured to couple the hanger to a tubular, wherein the dual lock system comprises a first lock ring and a second lock ring;

a piston assembly configured to actuate the first and second lock rings to couple the hanger to the tubular, wherein the piston assembly comprises first and second pistons configured to move together to actuate the first lock ring from a first unlocked position to a first locked position, and the second piston is configured to move relative to the first piston to actuate the second lock ring from a second unlocked position to a second locked position.

2. The system of claim 1, wherein the first lock ring comprises an outer lock ring, the second lock ring comprises an inner lock ring, and the dual lock system comprises an outer energizing ring and an inner energizing ring that drive the respective outer lock ring and the inner lock ring in response to movement of the first and second pistons.

3. The system of claim 2, comprising a setting tool configured to axially drive the inner and outer energizing rings.

4. The system of claim 3, wherein the setting tool comprises the piston assembly having the first and second pistons, the second piston comprises an inner piston configured to drive the inner energizing ring, and the first piston comprises an outer piston configured to drive the outer energizing ring.

5. The system of claim 4, wherein the inner and outer pistons are coupled together with a shear pin.

6. The system of claim 4, wherein the inner and outer pistons form a hydraulic cavity that enables hydraulic fluid to drive the inner and outer pistons simultaneously.

7. The system of claim 4, wherein the setting tool comprises a hydraulic block with one or more hydraulic passages and the inner and outer pistons surround the hydraulic block, wherein the hydraulic block couples to the hanger.

8. The system of claim 1, comprising a controller configured to facilitate alignment of the hanger within the tubular.

9. A system, comprising:

a dual lock system configured to lock a mineral extraction system component to a tubular, wherein the dual lock system comprises:

a first lock configured to couple to the tubular; and a second lock configured to couple to the mineral extraction system component, wherein the first and second locks move radially to lock the mineral extraction system component within the tubular a tool comprising first and second portions, wherein the first and second portions are configured to move axially together to actuate the first lock, and the second portion is configured to move axially relative to the first portion to actuate the second lock.

10. The system of claim 9, wherein the mineral extraction system component comprises a tubing hanger.

11. The system of claim 9, wherein the first lock is configured to move in a first radial direction between a first unlocked position and a first locked position, the second lock is configured to move in a second radial direction between a second unlocked position and a second locked position, and the first and second radial directions are opposite from one another.

12. The system of claim 9, wherein the first lock comprises an outer lock ring and the second lock comprises an inner lock ring, wherein the dual lock system further comprises an outer energizing ring configured to energize the outer lock ring by driving the outer lock ring radially outward into a first groove of the tubular and an inner energizing ring configured to energize the inner lock ring by driving the inner lock ring radially inward into a second groove of the mineral extraction system component.

13. The system of claim 12, wherein the first and second portions of the tool comprise respective inner and outer pistons configured to drive the inner and outer energizing rings.

14. The system of claim 9, wherein the first and second portions of the tool comprise first and second pistons.

15. The system of claim 13, wherein the first and second pistons are coupled together with a shear structure.

16. A method, comprising:

coupling a setting tool to a mineral extraction system component;

lowering the setting tool with the mineral extraction system component into a bore of a tubular; and energizing a dual lock system having first and second locks to couple the mineral extraction system component to the tubular, wherein energizing comprises moving first and second pistons together to actuate the first lock, and moving the second piston axially relative to the first piston to actuate the second lock.

17. The method of claim 16, wherein moving the second piston axially relative to the first piston comprises shearing a shear structure.

18. The method of claim 16, wherein energizing the dual lock system comprises moving the first lock in a first radial direction between a first unlocked position and a first locked position, moving the second lock in a second radial direction between a second unlocked position and a second locked position, and the first and second radial directions are opposite from one another.

19. The system of claim 1, wherein the first and second pistons are coupled together with a shear structure.

20. A system, comprising:

a tool comprising first and second pistons, wherein the first and second pistons are configured to move axially together to actuate a first lock of a lock assembly from a first unlocked position to a first locked position to couple with a tubular, the second piston is configured to move axially relative to the first piston to actuate a second lock of the lock assembly from a second unlocked position to a second locked position with a mineral extraction system component, and the tool is configured to be retrieved after actuating the first and second locks of the lock assembly.

21. The system of claim 20, wherein the first and second pistons are coupled together with a shear structure.

22. The system of claim 20, comprising the lock assembly having the first and second locks.

* * * * *